US008253342B2

(12) United States Patent
Ku et al.

(10) Patent No.: US 8,253,342 B2
(45) Date of Patent: Aug. 28, 2012

(54) LIGHT EMITTING DIODE ILLUMINATION SYSTEM

(75) Inventors: Chin-Long Ku, Taipei Hsien (TW); Huai-Qing Zheng, Shenzhen (CN); Shao-Lin Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 204 days.

(21) Appl. No.: 12/788,314

(22) Filed: May 27, 2010

(65) Prior Publication Data

US 2011/0156605 A1 Jun. 30, 2011

(30) Foreign Application Priority Data

Dec. 30, 2009 (CN) ..... 2009 1 0312827

(51) Int. Cl.
*H05B 37/02* (2006.01)

(52) U.S. Cl. ..... 315/186; 315/185 R; 315/209 R; 315/291; 315/307; 315/308

(58) Field of Classification Search ..... 315/185 S, 315/185 R, 186, 209 R, 291, 294, 307, 308
See application file for complete search history.

(56) References Cited

U.S. PATENT DOCUMENTS 6,445,142 B1 * 9/2002 Xia et al. ..... 315/307
7,411,360 B2 * 8/2008 Henry ..... 315/307
7,642,725 B2 * 1/2010 Cusinato et al. ..... 315/185 S
7,675,246 B2 * 3/2010 Chiang et al. ..... 315/291
2006/0238466 A1 * 10/2006 Chen et al. ..... 345/82
2007/0114951 A1 * 5/2007 Tsen et al. ..... 315/291
2007/0210722 A1 * 9/2007 Konno et al. ..... 315/185 S
2008/0061716 A1 * 3/2008 Kim et al. ..... 315/307
2008/0157699 A1 * 7/2008 Lee et al. ..... 315/294
2009/0167197 A1 * 7/2009 Wang et al. ..... 315/185 R
2009/0289559 A1 * 11/2009 Tanaka et al. ..... 315/185 R
2011/0115396 A1 * 5/2011 Horvath et al. ..... 315/250

FOREIGN PATENT DOCUMENTS

WO WO 2004038881 A2 * 5/2004

* cited by examiner

*Primary Examiner* — Douglas W Owens
*Assistant Examiner* — Thai Pham
(74) *Attorney, Agent, or Firm* — Altis Law Group, Inc.

(57) ABSTRACT

An LED illumination system includes an LED lamp, a voltage stabilizing circuit and a control circuit. The LED lamp includes an LED string which has a plurality of LEDs connected in series. The voltage stabilizing circuit connects the LED lamp for supplying an electric current to the LED string. The control circuit includes an MCU and a MOSFET connected between the MCU and the LED string. The MCU detects the electric current flowing through the LED string and outputs a PWM signal which has a frequency within a range from 60 Hz to 500 Hz to the MOSFET. The MOSFET receives the PWM signal from the MCU and turns on and off repeatedly under a control of the PWM signal, to make a flicker frequency of the LEDs of the LED string be within a predetermined range.

6 Claims, 1 Drawing Sheet

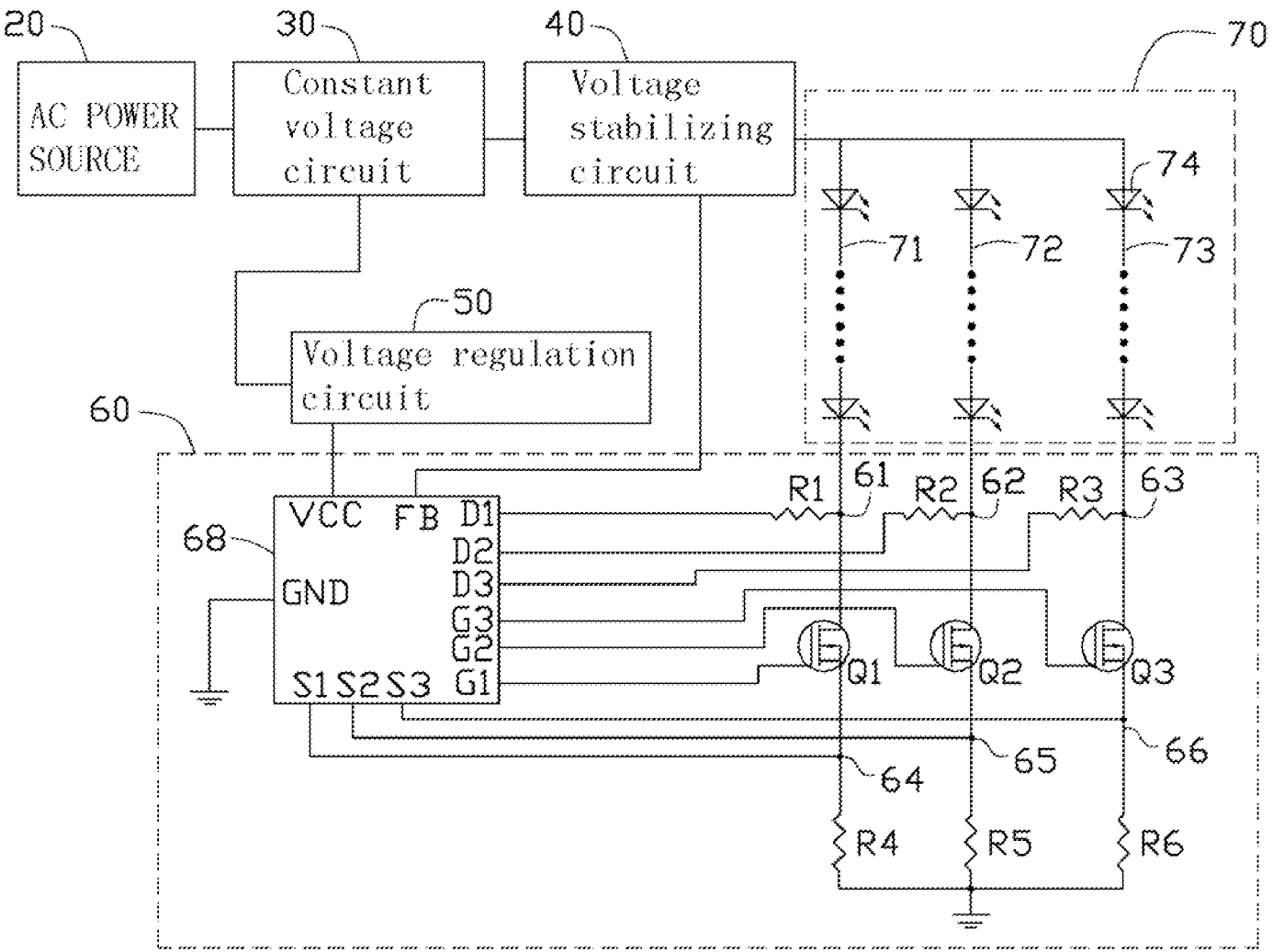
70
74
73
72
71
63
62
61
R3
R2
R1
Q3
Q2
Q1
66
65
64
R6
R5
R4
Voltage stabilizing circuit
40
Constant voltage circuit
30
AC POWER SOURCE
20
Voltage regulation circuit
50
VCC
FB
D1
D2
D3
G3
G2
G1
GND
S1
S2
S3
68
60

LIGHT EMITTING DIODE ILLUMINATION SYSTEM

BACKGROUND

1. Technical Field

The present disclosure relates to LED (light emitting diode) illumination systems, and more particularly to an LED illumination system having a low energy consumption.

2. Description of Related Art

LEDs have been available since the early 1960s. Compared with the conventional light sources, such as fluorescent lamps, halogen lamps and incandescent lamps, the LEDs have a higher electro-optical conversion efficiency. Thus, nowadays LED usage has been increased in popularity in various applications, particularly, the applications needing large power consumption, in order to reduce operation cost of these applications.

Generally, an LED lamp is connected to a constant current source for obtaining electric power therefrom. During operation, the constant current source receives a PWM signal with a frequency which is between 10 KHz and 500 KHz, and outputs a constant electric current to the LED lamp according to the received PWM signal, to make the LEDs of the LED lamp always have a radiation of constant intensity during illumination thereof. Such LED lamp would still waste a large amount of power if it always maintains the constant-intensity radiation of the LEDs during the operation thereof.

It is thus desirable to provide an LED illumination system which can overcome the described limitations.

BRIEF DESCRIPTION OF THE DRAWINGS

The only FIGURE is a circuit diagram illustrating an LED illumination system according to an exemplary embodiment.

DETAILED DESCRIPTION

Reference will now be made to the drawing FIGURE to describe the present LED illumination system in detail.

Referring to the only FIGURE, an LED illumination system includes an AC power source 20, a constant voltage circuit 30, a voltage stabilizing circuit 40, a voltage regulation circuit 50, a control circuit 60 and an LED lamp 70. The constant voltage circuit 30 is interconnected between the AC power source 20 and the voltage stabilizing circuit 40. The voltage stabilizing circuit 40 is connected to the LED lamp 70. The voltage regulating circuit 50 is interconnected between the constant voltage circuit 30 and the control circuit 60.

The LED lamp 70 includes a first LED string 71, a second LED string 72 and a third LED string 73 connected to each other in parallel. Each of the first, second and third LED strings 71, 72, 73 includes a plurality of LEDs 74 connected to each other in series. In this embodiment, numbers of the LEDs 74 included in the first, second and third LED strings 71, 72, and 73 are the same as each other.

The control circuit 60 includes a micro-programmed control unit (MCU) 68, a plurality of switch transistors, and a plurality of resistors. In this embodiment, the switch transistors includes a first, a second and a third N-channel enhancement mode metal-oxide-semiconductor field effect transistors (MOSFETs) Q1, Q2 Q3 corresponding to the first, second and third LED strings 71, 72, 73 respectively. Drains of the first, second and third MOSFETs Q1, Q2 Q3 are connected to negative poles of the first, second and third LED strings 71, 72, 73, respectively. A first junction 61 is formed between the drain of the first MOSFET Q1 and the negative pole of the first LED string 71. A second junction 62 is formed between the drain of the second MOSFET Q2 and the negative pole of the second LED string 72. A third junction 63 is formed between the drain of the third MOSFET Q3 and the negative pole of the third LED string 73.

The MCU 68 includes a power on terminal VCC, a feedback terminal FB, a ground terminal GND, a first, second and third control terminals G1, G2, G3 respectively connected to gates of the first, second and third MOSFETs Q1, Q2 Q3, a first, second and third comparing terminals S1, S2, S3, and a first, second and third input terminals D1, D2, D3. The control terminals G1, G2, G3 of the MCU 68 can output different PWM signals which have different frequencies to the first, second and third MOSFETs Q1, Q2 Q3 according to illumination needs.

The resistors include a first, second and third current limiting resistors R1, R2, R3, and a first, second and third current detecting resistors R4, R5, R6. The first current limiting resistor R1 is connected between the first junction 61 and the first input terminal D1. The second current limiting resistor R2 is connected between the second junction 62 and the second input terminal D2. The third current limiting resistor R3 is connected between the third junction 63 and the third input terminal D3. Each of the first, second and third current limiting resistors R1, R2, R3 has a very large resistance, thereby making the first, second and third input terminals D1, D2, D3 respectively be at a high resistance state. In this embodiment, each of the first, second and third current limiting resistors R1, R2, R3 is 10 megohm (MΩ).

Sources of the first, second and third MOSFETs Q1, Q2 Q3 are connected to the ground via the first, second and third current detecting resistors R4, R5, R6, respectively. The resistances of the first, second and third current detecting resistors R4, R5, R6 are the same as each other. A fourth junction 64 is formed between the source of the first MOSFET Q1 and the first current detecting resistor R4. A fifth junction 65 is formed between the source of the second MOSFET Q2 and the second current detecting resistor R5. A sixth junction 66 is formed between the source of the third MOSFET Q3 and the third current detecting resistor R6. The first, second and third comparing terminals S1, S2, S3 of the MCU 68 are respectively connected to the fourth, fifth and sixth junctions 64, 65, 66. The power on terminal VCC of the MCU 68 is connected to the voltage regulation circuit 50 for obtaining electric power therefrom. The feedback terminal FB of the MCU 68 is connected to the voltage stabilizing circuit 40. The MCU 68 can output a feedback signal to the voltage stabilizing circuit 40 via the feedback terminal FB, to control the voltage stabilizing circuit 40 to output a predetermined voltage to the LED lamp 70, ensuring that an electric current flowing through at least one of the LED strings 71, 72, 73 is equal to a specific amperage, whilst the electric currents flowing through the remaining LED strings 71, 72, 73 is not less than the specific amperage.

The MCU 68 sets a reference voltage therein. The reference voltage is equal to a product of the specific amperage and the resistance of one of the current detecting resistors R4, R5, R6. When in operation, the MCU 68 compares voltages of the first, second and third comparing terminals S1, S2, S3 with the reference voltage, and outputs different PWM signals via the first, second and third control terminals G1, G2, G3 to the gates of the first, second and third MOSFETs Q1, Q2, Q3, respectively, according to the compared results. The voltage of the first comparing terminal S1 is obtained by multiplying a first electric current which flows through the first LED string 71 and the resistance of the first current detecting resistor R4.

Similarly, the voltage of the second comparing terminal S2 is obtained by multiplying a second electric current flowing through the second LED string 72 and the resistance of the second current detecting resistor R5, and the voltage of the third comparing terminal S3 is obtained by multiplying a third electric current flowing through the third LED string 73 and the resistance of the third current detecting resistor R6.

During operation, the constant voltage circuit 30 receives an AC power from the AC power source 20, converts the AC power into a constant DC power, and outputs the constant DC power to the voltage regulating circuit 50 and the voltage stabilizing circuit 40 separately. The voltage regulation circuit 50 converts the constant DC power received from the constant voltage circuit 30 to a working voltage of the MCU 68 and then supplies the working voltage to the MCU 68. Since the voltage stabilizing circuit 40 is connected to the feedback terminal FB of the control circuit 60, the MCU 68 compares the voltages of the first, second and third comparing terminals S1, S2, S3 with the reference voltage, and outputs the feedback signal to the voltage stabilizing circuit 40 via the feedback terminal FB, to thereby control the voltage stabilizing circuit 40 to output the predetermined voltage to the LED lamp 70. Simultaneously, the MCU 68 compares the voltages of the first, second and third comparing terminals S1, S2, S3 with the reference voltage, and outputs different PWM signals to the first, second and third MOSFETs Q1, Q2, Q3 via the first, second and third control terminal G1, G2, G3, to thereby control a flickering frequency of each of the first, second and third LED strings 71, 72, 73 within a predetermined range.

The working principle of the control circuit 60 of the LED illumination system will hereinafter be explained in a greater detail. It is to be understood that the first LED string 71, the second LED string 72 and the third LED string 73 are worked at a very similar way to each other. Thus, here, only the first LED string 71 is described for a concise description. Supposing that when the predetermined voltage is supplied to the LED lamp 70 by the voltage stabilizing circuit 40, the first electric current flowing through the first LED string 71 exceeds the specific amperage, whilst the second electric current and the third electric current which flow through the second LED string 72 and the third LED string 73, respectively, are both equal to the specific amperage. Since the voltage of the first comparing terminal 51 of the MCU 68 is obtained by multiplying the first electric current and the resistance of the first current detecting resistor R4, when the MCU 68 compares the voltage of the first comparing terminal 51 with the reference voltage, it can detect that the voltage of the first comparing terminal S1 is larger than the reference voltage. Thus, the MCU 68 outputs a PWM signal having a pre-established frequency via the first control terminal G1 to the gate of the first MOSFET Q1.

It is well known that the PWM signal having different frequencies can change an effective voltage which is applied to a MOSFET to turn the MOSFET on, thereby changing an internal resistance of the MOSFET after the MOSFET has been turned on, according a characteristic of MOSFET. Since the first MOSFET Q1 and the first LED string 71 are connected in series between the voltage stabilizing circuit 40 and the ground, when the internal resistance of the first MOSFET Q1 is changed, the first electric current flowing through the first LED string 71 is accordingly changed. At this state, since the first electric current flowing through the first LED string 71 exceeds the specific amperage, the pre-established PWM signal which is outputted by the MCU 68 to the first MOSFET Q1 is configured to increase the internal resistance of the first MOSFET Q1. Accordingly, the first electric current flowing through the first LED string 71 can be decreased to be equal to the specific amperage.

Supposes that the pre-established PWM signal outputted to the first MOSFET Q1 is 100 Hz. During high levels of the PWM signal, the gate of the first MOSFET Q1 is at a high level and the first MOSFET Q1 is turned on accordingly. Since the first MOSFET Q1 is turned on, a close loop is formed by the voltage stabilizing circuit 40, the first LED string 71, the first MOSFET Q1, the first current detecting resistor R4 and the ground. Thus, the first electric current flows through the LEDs 74 of the first LED string 71 to drive the LEDs 74 to emit light. During low levels of the PWM signal, the gate of the first MOSFET Q1 is at a low level and the first MOSFET Q1 is turned off. Thus, an open circuit is formed between the first LED string 71 and ground, no electric current can flow through the LEDs 74 of the first LED string 71 to drive the LEDs 74 to emit light. Accordingly, the first MOSFET Q1 receives the PWM signal from the MCU 68 and turns on and off repeatedly under the control of the PWM signal, thereby making the LEDs 74 of the first LED string 71 flicker with a frequency the same as the frequency of the PWM signal. Preferably, the frequency of the PWM signal is within a range from 60 Hz to 500 Hz, and a flicker frequency of the LEDs 74 is within a predetermined range from 60 Hz to 500 Hz. In such a range, eye can not sense the flicker of the LEDs 74 due to an afterglow effect thereof, thereby avoiding discomfort of the users. Moreover, the LEDs 74 are actually turned off during the low levels of the PWM signal during the illumination period, thereby saving energy.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED illumination system comprising:

an LED lamp comprising an LED string which has a plurality of LEDs connected in series;

a voltage stabilizing circuit connected to the LED lamp for supplying an electric current to the LED string; and a control circuit comprising a micro-programmed control unit and a MOSFET connected between the micro-programmed control unit and the LED string, the micro-programmed control unit detecting the electric current flowing through the LED string and outputting a PWM signal which has a frequency within a range from 60 Hz to 500 Hz to the MOSFET, the MOSFET receiving the PWM signal from the micro-programmed control unit and turning on and off repeatedly under a control of the PWM signal, making a flicker frequency of the LEDs of the LED string be within a predetermined range;

wherein the MOSFET is a N-channel enhancement mode MOSFET, the micro-programmed control unit comprising a control terminal connected to a gate of the MOSFET, a drain of the MOSFET being connected to a negative pole of the LED string, a source of the MOSFET being connected to the ground via a current detecting resistor, the PWM signal being outputted by the control terminal;

wherein a junction is formed between the current detecting resistor and the source of the MOSFET, the micro-programmed control unit further comprising a comparing terminal connected to the junction, the micro-programmed control unit setting a reference voltage therein, the micro-programmed control unit comparing a voltage of the comparing terminal with the reference voltage and outputting different PWM signals which have different frequencies to the MOSFET according to a compared result, thereby changing an internal resistance of the MOSFET after the MOSFET has been turned on; and wherein the micro-programmed control unit comprises a feedback terminal connected to the voltage stabilizing circuit, the micro-programmed control unit detecting the electric current flowing through the LED string and outputting a feedback signal to the voltage stabilizing circuit, to control the voltage stabilizing circuit to output a predetermined voltage to the LED lamp, the micro-programmed control unit compares the voltages of a first, a second and a third comparing terminal with a reference voltage, and outputs different PWM signals to a first, a second and a third MOSFET via a first, a second and a third control terminal, thereby to control a flickering frequency of each of the first, second and third LED string within a predetermined range.

2. The LED illumination system of claim 1, wherein the voltage of the comparing terminal is obtained by multiplying the electric current flowing through the LED string and a resistance of the current detecting resistor.

3. The LED illumination system of claim 1, wherein a junction is formed between the negative pole of the LED string and the drain of the MOSFET, the micro-programmed control unit comprising an input terminal connected to the junction via a current limiting resistor.

4. The LED illumination system of claim 3, wherein the current limiting resistor has a resistance of 10 megohm.

5. The LED illumination system of claim 1, further comprising an AC power source, a constant voltage circuit connected between the AC power source and a voltage regulation circuit connected to the constant voltage circuit, the constant voltage circuit receiving an AC power from the AC power source, converting the AC power into a constant DC power, and outputting the constant DC power to the voltage regulating circuit, the voltage regulation circuit converting the constant DC power to a working voltage of the micro-programmed control unit and supplying the working voltage to the micro-programmed control unit.

6. The LED illumination system of claim 5, wherein the voltage stabilizing circuit is connected between the constant voltage circuit and the LED lamp, the LED lamp further comprising another LED string connected in parallel with the LED string, the voltage stabilizing circuit being configured to output a predetermined voltage to ensure the electric current flowing through the LED string and an electric current flowing through the another LED string both being not less than a specific amperage.

* * * * *